US009400446B1

(12) United States Patent
Motegi

(10) Patent No.: US 9,400,446 B1
(45) Date of Patent: Jul. 26, 2016

(54) IMAGE FORMING APPARATUS

(71) Applicant: FUJI XEROX CO., LTD., Tokyo (JP)

(72) Inventor: Yuma Motegi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/817,306

(22) Filed: Aug. 4, 2015

(30) Foreign Application Priority Data

Mar. 20, 2015 (JP) ..... 2015-057812

(51) Int. Cl.
*G03G 15/06* (2006.01)

(52) U.S. Cl.
CPC ..... *G03G 15/065* (2013.01)

(58) Field of Classification Search
CPC ..... G03G 15/065
See application file for complete search history.

(56) References Cited

U.S. PATENT DOCUMENTS

2004/0057739 A1* 3/2004 Shimura ..... G03G 15/5041 399/49
2014/0301749 A1* 10/2014 Fukusaka ..... G03G 15/065 399/55
2014/0301750 A1* 10/2014 Fukusaka ..... G03G 15/065 399/55

FOREIGN PATENT DOCUMENTS

JP 09054487 A * 2/1997
JP 2012-255834 A 12/2012

OTHER PUBLICATIONS

Machine Translation of JP 09054487.*

* cited by examiner

*Primary Examiner* — G. M. Hyder
(74) *Attorney, Agent, or Firm* — Sughrue Mion, PLLC

(57) ABSTRACT

An image forming apparatus includes an image carrier that holds a developer image, a developer transport unit that transports a developer to the image carrier by performing a rotational movement, a voltage application unit that applies, between the developer transport unit and the image carrier, a voltage that contains a direct-current voltage component and an alternating-current voltage component and that is used for transporting the developer from the developer transport unit to the image carrier, and a detector that detects a rotation phase of the developer transport unit from an alternating-current component waveform of a power supply of the voltage application unit.

14 Claims, 9 Drawing Sheets

IMAGE FORMING APPARATUS

CROSS-REFERENCE TO RELATED APPLICATIONS

This application is based on and claims priority under 35 USC 119 from Japanese Patent Application No. 2015-057812 filed Mar. 20, 2015.

BACKGROUND

Technical Field

The present invention relates to an image forming apparatus.

SUMMARY

According to an aspect of the invention, there is provided an image forming apparatus including an image carrier that holds a developer image, a developer transport unit that transports a developer to the image carrier by performing a rotational movement, a voltage application unit that applies, between the developer transport unit and the image carrier, a voltage that contains a direct-current voltage component and an alternating-current voltage component and that is used for transporting the developer from the developer transport unit to the image carrier, and a detector that detects a rotation phase of the developer transport unit from an alternating-current component waveform of a power supply of the voltage application unit.

BRIEF DESCRIPTION OF THE DRAWINGS

An exemplary embodiment of the present invention will be described in detail based on the following figures, wherein.

DETAILED DESCRIPTION

An exemplary embodiment of the present invention will now be described in detail with reference to the drawings.

Figure 1:
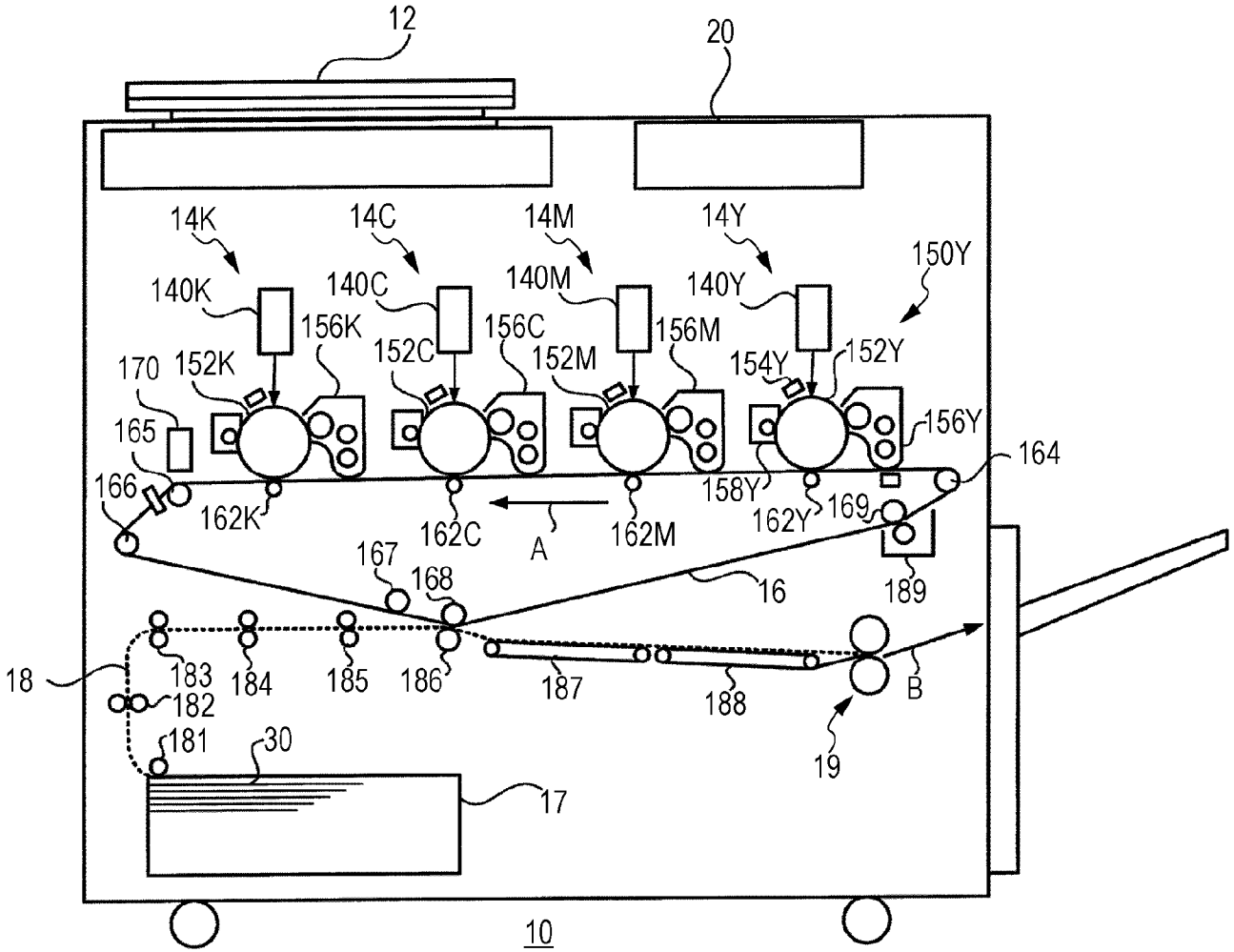
FIG. 1 is a diagram illustrating a configuration of an image forming apparatus according to an exemplary embodiment of the present invention.

FIG. 1 is a diagram illustrating the configuration of an image forming apparatus 10 according to the exemplary embodiment of the present invention.

As illustrated in FIG. 1, the image forming apparatus 10 includes an image reading device 12, image forming units 14K, 14C, 14M, and 14Y, an intermediate transfer belt 16, a sheet tray 17, a sheet transport path 18, a fixing unit 19, and a controller 20. The image forming apparatus 10 may be a multifunction machine that has a printer function that prints image data, which is received from a personal computer (not illustrated) or the like, and also has a function of serving as a full-color copying machine using the image reading device 12 and a function of serving as a facsimile machine.

An overview of the image forming apparatus 10 will be described first. The image reading device 12 and the controller 20 are disposed in an upper portion of the image forming apparatus 10 and each function as a unit for inputting image data. The image reading device 12 reads an image of a document and outputs the image to the controller 20. The controller 20 performs image processing, such as gradation correction and resolution correction, on image data that is input therein by the image reading device 12 or image data that is input therein by a personal computer (not illustrated) or the like via a network line, such as a LAN, and then outputs the image data to the image forming units 14.

The four image forming units 14K, 14C, 14M, and 14Y, each of which corresponds to one of the colors of color images, are disposed below the image reading device 12. In the present exemplary embodiment, the four image forming units 14K, 14C, 14M, and 14Y that correspond to black (K), cyan (C), magenta (M), and yellow (Y), respectively, are horizontally arranged with a predetermined interval therebetween along the intermediate transfer belt 16. The intermediate transfer belt 16 serves as an intermediate transfer body and rotates in the direction of arrow A in FIG. 1, and the four image forming units 14K, 14Y, 14M, and 14C sequentially form toner images of the corresponding colors on the basis of image data input by the controller 20 and transfer (in a first transfer process) the plural toner images onto the intermediate transfer belt 16 at the timing at which the plural toner images are superposed with one another. Note that the image forming units 14K, 14C, 14M, and 14Y are not limited to being arranged in the order of colors K, C, M, and Y and may be in any order (e.g., Y, M, C, and K).

The sheet transport path 18 is disposed below the intermediate transfer belt 16. One of the recording sheets 30 that is supplied from the sheet tray 17 is transported along the sheet transport path 18, and toner images, which have been transferred to the intermediate transfer belt 16 in such a manner that the toner images are superposed with one another, are collectively transferred (in a second transfer process) on to the recording sheet 30. Then, the toner images, which have been transferred to the recording sheet 30, is fixed onto the recording sheet 30 by the fixing unit 19, and the recording sheet 30 is ejected to the outside in the direction of arrow B.

The configuration of each unit included in the image forming apparatus 10 will now be described in further detail.

The controller 20 performs predetermined image processing, such as shading correction, document misregistration correction, brightness/color space conversion, gamma correction, frame erase, and color/movement editing, on image data read by the image reading device 12. Note that optical images reflected from a color material of the document, which is read by the image reading device 12, are document-reflectance data items, each of which has one of three colors of, for example, red (R), green (G), and blue (B) and each of which is composed of 8 bits, and these document reflectance data items are converted into document-color-material-gradation data items, each of which has one of four colors of K, C, M, and Y and each of which is composed of 8 bits through the image processing performed by the controller 20.

The image forming units 14K, 14C, 14M, and 14Y (image forming units) are arranged side by side with a predetermined interval therebetween in the horizontal direction, and the configurations of the image forming units 14K, 14C, 14M, and 14Y are substantially similar to one another except for the colors of images formed by the image forming units 14K, 14C, 14M, and 14Y. Accordingly, the image forming unit 14K will be described below. Note that the configurations of the image forming units 14 will be described in such a manner as to be distinguished in terms of color by adding the letters K, C, M, and Y to the reference numeral 14.

The image forming unit 14K includes a light scanning device 140K that causes a laser beam to scan a photoconductor drum 152K in accordance with image data, which is input from the controller 20, and an image forming device 150K that forms an electrostatic latent image by using the laser beam, which is caused to scan the photoconductor drum 152K by the light scanning device 140K.

The light scanning device 140K modulates the laser beam in accordance with a black (K) image data and radiates the modulated laser beam onto the photoconductor drum 152K of the image forming device 150K.

The image forming device 150K includes the photoconductor drum 152K that performs a rotational movement in the direction of arrow A at a predetermined rotation speed, a charging device 154K serving as a charging unit that uniformly charges a surface of the photoconductor drum 152K, a developing device 156K that develops an electrostatic latent image formed on the photoconductor drum 152K, and a cleaning device 158K. The photoconductor drum 152K is an image carrier, which has a cylindrical shape or a substantially cylindrical shape and holds a developer image, such as a toner image, and is uniformly charged by the charging device 154K. An electrostatic latent image is formed on the photoconductor drum 152K by the laser beam that is radiated from the light scanning device 140K. The electrostatic latent image formed on the photoconductor drum 152K is developed by the developing device 156K with a developer, such as a black (K) toner, and transferred onto the intermediate transfer belt 16. Note that residual toner, paper dust, and the like that remain on the photoconductor drum 152K after a process of transferring a toner image (developer image) is removed by the cleaning device 158K.

Similar to the image forming unit 14K, the image forming unit 14C includes a photoconductor drum 152C and a developing device 156C and forms a toner image of cyan (C). The image forming unit 14M includes a photoconductor drum 152M and a developing device 156M and forms a toner image of magenta (M). The image forming unit 14Y includes a photoconductor drum 152Y and a developing device 156Y and forms a toner image of yellow (Y). These toner images of the different colors, which are formed, are transferred onto the intermediate transfer belt 16.

The intermediate transfer belt 16 is stretched by a drive roller 164, idle rollers 165, 166, and 167, a backup roller 168, and an idle roller 169 with a certain tension and is driven so as to rotate at a predetermined speed in the direction of arrow A as a result of the drive roller 164 being driven by a drive motor (not illustrated) so as to rotate. The intermediate transfer belt 16 has the form of an endless belt obtained by, for example, forming a flexible film made of a synthetic resin, such as a polyimide, into a belt-like shape and joining the ends of the synthetic resin film, which is formed in a belt-like shape, to each other by welding or the like.

First transfer rollers 162K, 162C, 162M, and 162Y are disposed on the intermediate transfer belt 16 at positions facing the image forming units 14K, 14C, 14M, and 14Y, respectively, and toner images of the different colors formed on the photoconductor drums 152K, 152C, 152M, and 152Y are transferred onto the intermediate transfer belt 16 by the first transfer rollers 162 in such a manner that the toner images are superposed with one another. Note that residual toner that remains on the intermediate transfer belt 16 is removed by a cleaning blade or a brush of a belt cleaning device 189 that is disposed on a downstream side of a second transfer position.

A density sensor 170 is disposed in the vicinity of the intermediate transfer belt 16. The density sensor 170 is a sensor that is used for reading toner images transferred to the intermediate transfer belt 16.

A sheet feed roller 181 that picks up one of the recording sheets 30 from the sheet tray 17, first pair of rollers 182, second pair of rollers 183, third pair of rollers 184 that are used for transporting the recording sheet 30, and registration rollers 185 that transport the recording sheet 30 to the second transfer position at a predetermined timing are disposed on the sheet transport path 18.

A second transfer roller 186 that is pressed into contact with the backup roller 168 is disposed at the second transfer position on the sheet transport path 18, and toner images of the different colors, which have been transferred to the intermediate transfer belt 16 in such a manner that the toner images are superposed with one another, are transferred in the second transfer process onto the recording sheet 30 with a press-contact force and an electrostatic force exerted by the second transfer roller 186. The recording sheet 30, to which the toner images of the different colors have been transferred, is transported to the fixing unit 19 by a transport belt 187 and a transport belt 188.

The fixing unit 19 performs a heat treatment and a pressure treatment on the recording sheet 30, to which the toner images of the different colors have been transferred, so as to cause the toners to melt and become fixed onto the recording sheet 30.

The developing device 156K includes a developing roller (developer transport unit) 157K that has a cylindrical shape and transports the developer to the photoconductor drum 152K by performing a rotational movement so as to form a developer image on the photoconductor drum 152K. Regarding the image forming units 14C, 14M, and 14Y, that form images of the other colors, similar to the image forming unit 14K, a developing roller is provided in each of the developing devices 156C, 156M, and 156Y.

A relationship between the photoconductor drum 152Y and the developing roller 157K in the image forming apparatus 10 according to the present exemplary embodiment will now be described with reference to FIG. 2. Note that, FIG. 2 only illustrates the configuration for forming a black image, and the configurations for forming images of the other colors of cyan, magenta, and yellow are similar to the configuration for forming a black image.

Figure 2:
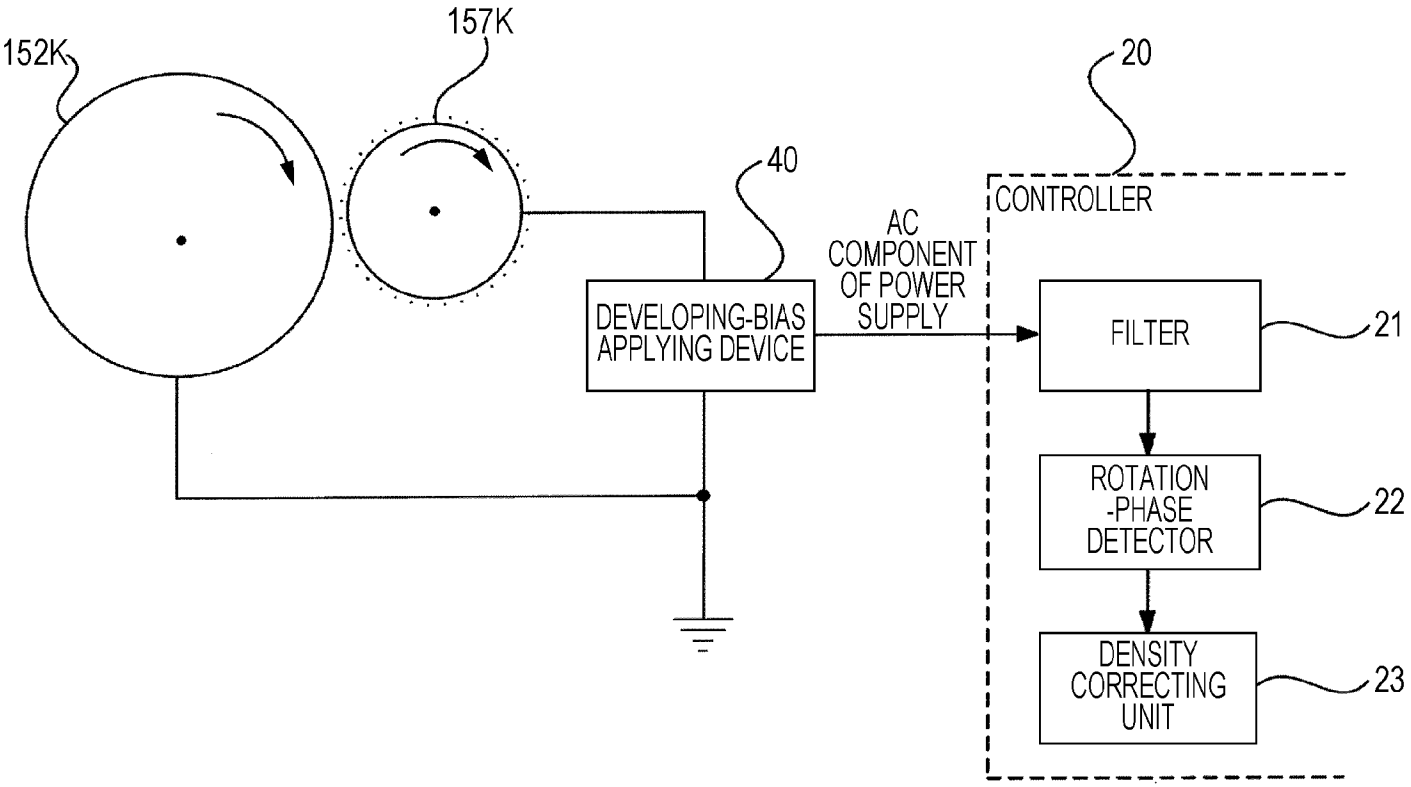
FIG. 2 is a diagram illustrating a relationship between a photoconductor drum and a developing roller in the image forming apparatus according to the exemplary embodiment of the present invention.

As illustrated in FIG. 2, the photoconductor drum 152K and the developing roller 157K are arranged in such a manner as to face each other with a predetermined interval (gap) therebetween. The developing roller 157K holds the developer on its surface by a magnetic force of a magnet, which is disposed in the developing roller 157K, and transports the developer to a gap defined between the developing roller 157K and the photoconductor drum 152K by performing a rotational movement so as to develop a latent image, which is formed on the surface of the photoconductor drum 152K, into a visible image.

As illustrated in FIG. 2, the image forming apparatus 10 according to the present exemplary embodiment includes a developing-bias applying device 40.

The developing-bias applying device 40 is a voltage application unit that applies, between the developing roller 157K and the photoconductor drum 152K, a voltage (developing bias), which is formed of a direct-current voltage component (DC voltage component) and an alternating-current voltage component (AC voltage component) and used for transporting the developer from the developing roller 157K to the photoconductor drum 152K.

Here, since both the photoconductor drum 152K and the developing roller 157K are made of a metal material, the photoconductor drum 152K and the developing roller 157K function in a similar way to a capacitor.

In the case where the photoconductor drum 152K, the developing roller 157K, and the like each have an ideal configuration, an AC component of a power supply of the developing-bias applying device 40 would have been zero on average. However, in the case where the gap between the photoconductor drum 152K and the developing roller 157K changes upon rotational movements of the photoconductor drum 152K and the developing roller 157K due to manufacturing tolerances and the like of the photoconductor drum 152K and the developing roller 157K, the capacitance of the capacitor formed of the photoconductor drum 152K and the developing roller 157K, also changes, and as a result, the value of the current of the AC component of the power supply included in the developing-bias applying device 40 changes.

The developing-bias applying device 40 according to the present exemplary embodiment includes a stabilizing circuit that performs feedback control so as to stabilize an output voltage.

The controller 20 detects rotation phases of the photoconductor drum 152K and the developing roller 157K by using the AC component waveform of the power supply of the developing-bias applying device 40 and corrects density variations (unevenness in density) due to rotation of the photoconductor drum 152K or the developing roller 157K.

A specific configuration in which the controller 20 detects the rotation phase of the photoconductor drum 152K or the developing roller 157K on the basis of an AC component waveform of the power supply of the developing-bias applying device 40 and corrects density variations will now be described.

As illustrated in FIG. 2, the controller 20 includes a filter 21, a rotation-phase detector 22, and a density correcting unit 23.

The filter 21 is a filter, such as a low-pass filter (LPF), that is used for removing high-frequency component noise from an AC component waveform of the power supply of the developing-bias applying device 40. The filter 21 may be realized by using, for example, a digital filter.

Note that providing the filter 21 may result in a delay. However, if the duration of a delay that occurs when a rotation phase is detected and the duration of a delay that occurs when density variations are actually corrected are the same as each other, such a delay will not be a problem when the density variations are corrected.

The rotation-phase detector 22 detects the rotation phase of the developing roller 157K on the basis of an AC component waveform of the power supply of the developing-bias applying device 40 that has passed through the filter 21.

More specifically, the rotation-phase detector 22 divides the AC component waveform of the power supply of the developing-bias applying device 40 into regions corresponding to each rotation period of the developing roller 157K and calculates the average value of the divided plural regions of the AC component waveform. Then, the rotation-phase detector 22 detects a feature point of the average value of the AC component waveform, which has been calculated, so as to set a reference point of the rotation phase of the developing roller 157K.

The density correcting unit 23 corrects density variations due to rotation of the developing roller 157K on the basis of the rotation phase of the developing roller 157K, which has been detected by the rotation-phase detector 22. More specifically, the density correcting unit 23 performs density corrections that cancel out the density variations due to the rotation of the developing roller 157K by synchronizing the rotation of the developing roller 157K and the density corrections with each other in accordance with a reference point set by the rotation-phase detector 22.

Note that the density correcting unit 23 may be configured not to correct the density variations by considering the density variations, which occur as a result of rotation of the developing roller 157K or the like, to be allowable values or smaller in the case where the variation amount of the AC component waveform of the power supply of the developing-bias applying device 40 is smaller than a predetermined value, that is, for example, in the case where the difference between the maximum value and the minimum value is a predetermined value or smaller.

The rotation-phase detector 22 may detect the rotation phase of the photoconductor drum 152K on the basis of the AC component waveform of the power supply of the developing-bias applying device 40.

In this case, the rotation-phase detector 22 divides the AC component waveform of the power supply of the developing-bias applying device 40 into regions corresponding to each rotation period of the photoconductor drum 152K and calculates the average value of the divided plural regions of the AC component waveform. Then, the rotation-phase detector 22 detects a feature point of the average value of the AC component waveform, which has been calculated, so as to set a reference point of the rotation phase of the photoconductor drum 152K.

Then, the density correcting unit 23 corrects density variations due to rotation of the photoconductor drum 152K on the basis of the rotation phase of the photoconductor drum 152K detected by the rotation-phase detector 22.

The detailed configuration of the density correcting unit 23 will now be described with reference to FIG. 3, which is a block diagram.

Figure 3:
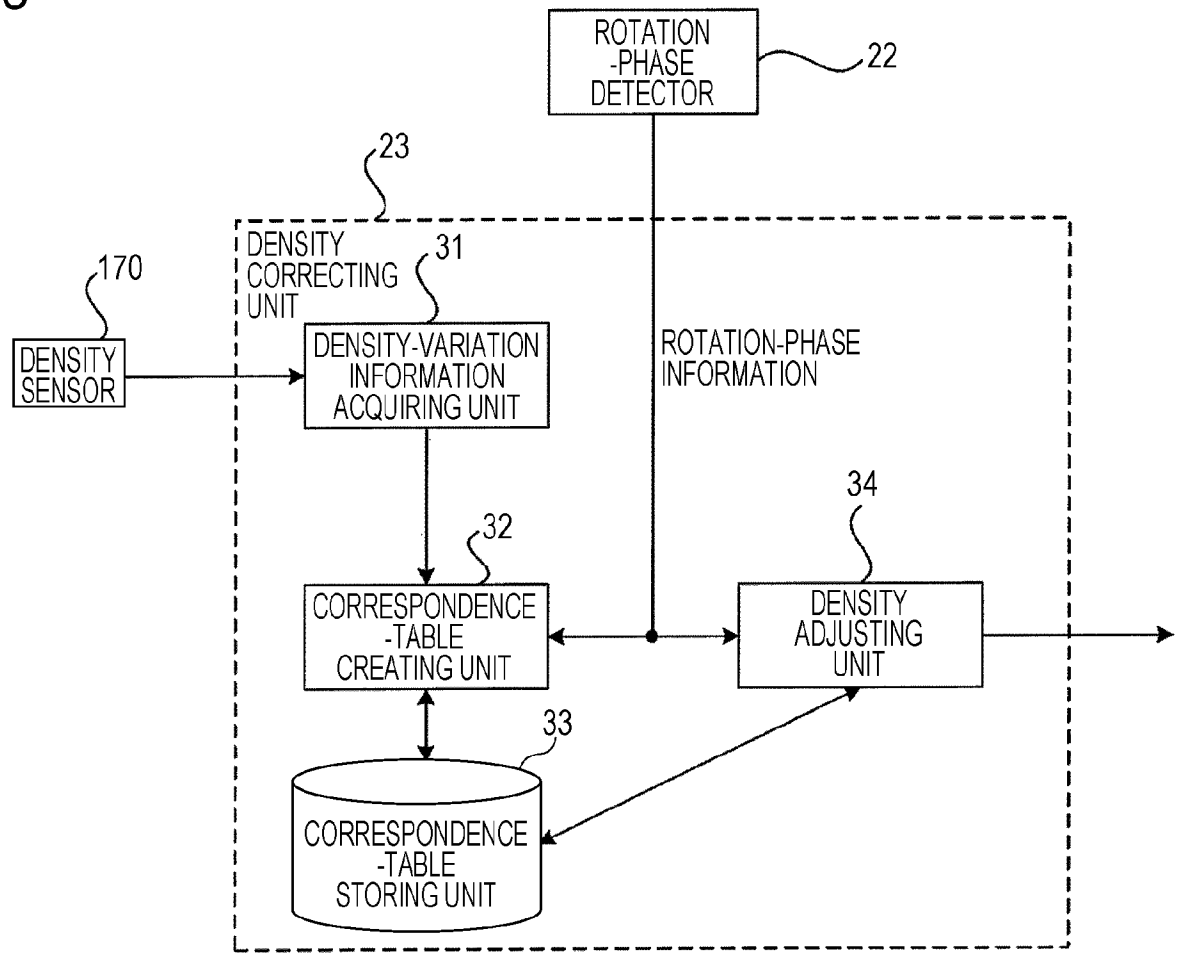
FIG. 3 is a block diagram illustrating a detailed configuration of a density correcting unit illustrated in FIG. 2.

As illustrated in FIG. 3, the density correcting unit 23 includes a density-variation information acquiring unit 31, a correspondence-table creating unit 32, a correspondence-table storing unit 33, and a density adjusting unit 34.

Although the case of correcting density variations that occur due to rotation of the developing roller 157K will be described below, a similar method may be used in the case of correcting density variations that occur due to rotation of the photoconductor drum 152K.

The density-variation information acquiring unit 31 acquires density-variation information that corresponds to the rotation phase of the developing roller 157K by detecting the density of an image that is formed on the photoconductor drum 152K with the developer, which has been transported by the developing roller 157K. More specifically, the density-variation information acquiring unit 31 detects the density value of a black toner image on the intermediate transfer belt 16, which has been detected by the density sensor 170.

Then, the correspondence-table creating unit 32 creates, on the basis of the density-variation information acquired by the density-variation information acquiring unit 31 and the information regarding the rotation phase of the developing roller 157K detected by the rotation-phase detector 22, a correspondence table in which a correction amount corresponding to the rotation phase of the developing roller 157K is specified.

The correspondence table, which is created by the correspondence-table creating unit 32 and in which the rotation phase of the developing roller 157K and a density correction amount are specified, is stored in the correspondence-table storing unit 33.

The density adjusting unit 34 adjusts the density value of each pixel of an image to be formed on the basis of the rotation phase of the developing roller 157K, which is detected by the rotation-phase detector 22, and the correspondence table, which is created by the correspondence-table creating unit 32 and stored in the correspondence-table storing unit 33.

A specific method of creating a density correction profile for detecting the rotation phase of the developing roller 157K and correcting density variations that occur due to rotation of the developing roller 157K will now be described with reference to FIG. 4A to FIG. 6B.

Figure 4A:
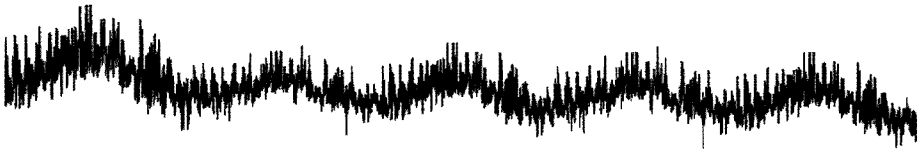
FIG. 4A and FIG. 4B, respectively are a diagram illustrating an exemplary waveform of an AC component of a power supply that is output by a developing-bias applying device and a diagram illustrating an exemplary waveform obtained after the waveform of the AC component of the power supply has passed through a filter.
Figure 4B:
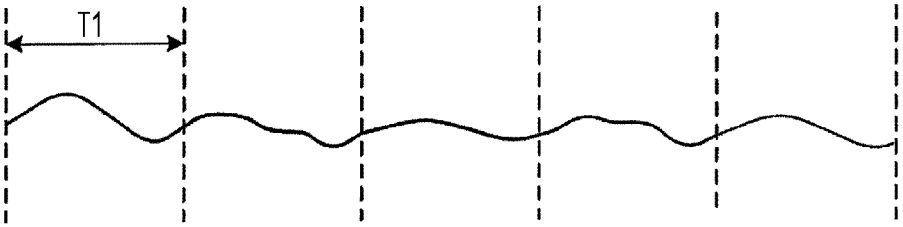

FIG. 4A illustrates an exemplary waveform of the AC component of the power supply that is output by the developing-bias applying device 40. FIG. 4B illustrates an exemplary waveform obtained after the waveform of the AC component of the power supply has passed through the filter 21.

In the case where the rotation-phase detector 22 detects the rotation phase of the developing roller 157K, the rotation-phase detector 22 divides the AC component waveform illustrated in FIG. 4B into regions corresponding to each rotation period T1 of the developing roller 157K.

Figure 5:
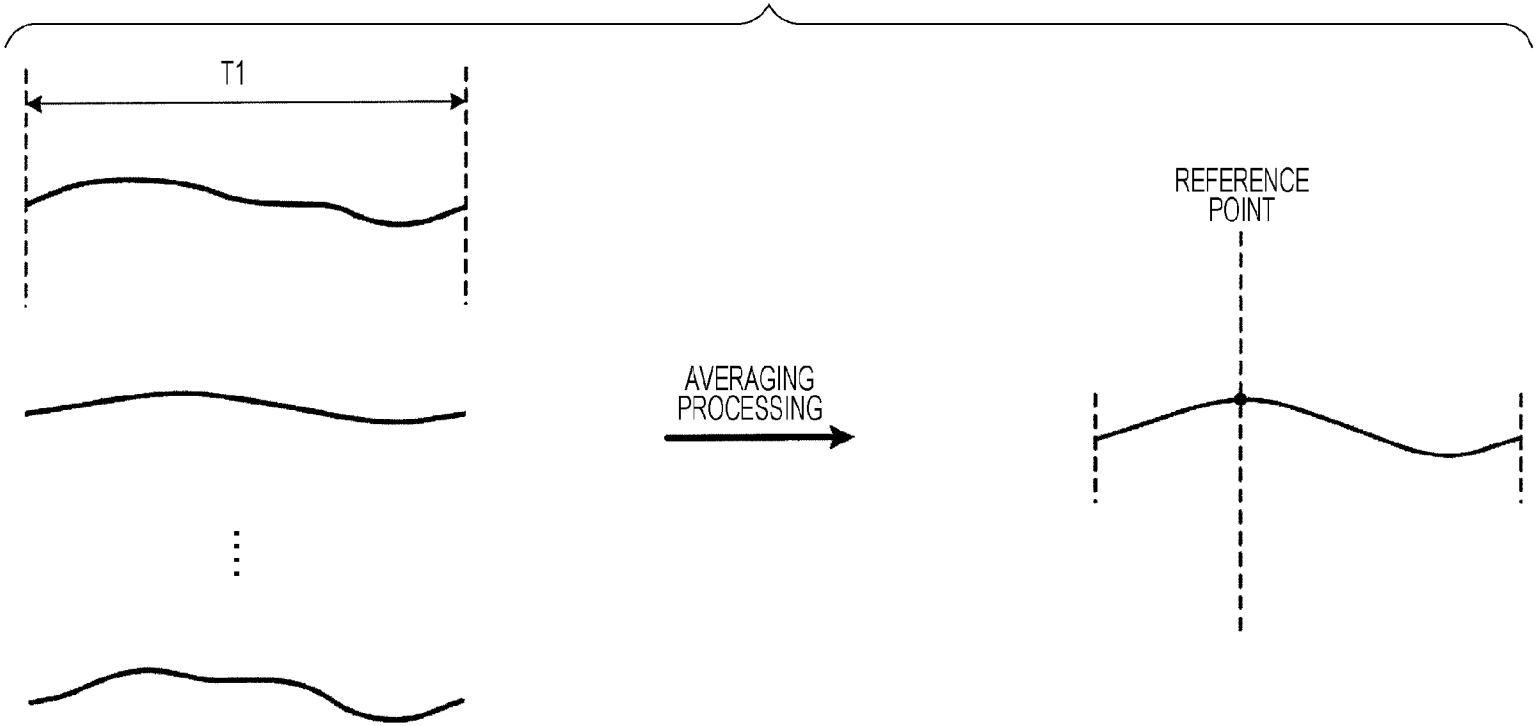
FIG. 5 is a diagram illustrating averaging processing performed by a rotation-phase detector.

Then, as illustrated in FIG. 5, the rotation-phase detector 22 performs averaging processing on the divided plural regions of the AC component waveform so as to calculate the average value and detects a feature point of the average value of the AC component waveform, which has been calculated.

More specifically, the rotation-phase detector 22 detects feature points, which are the maximum value, the minimum value, and the like of the AC component waveform that has undergone the averaging processing, and sets a reference point of the rotation phase of the developing roller 157K by using each of the feature points as a reference position.

In the example illustrated in FIG. 5, the rotation-phase detector 22 sets the minimum value of the AC component waveform, which has undergone the averaging processing, as the reference point of the rotation phase of the developing roller 157K.

Figure 6A:
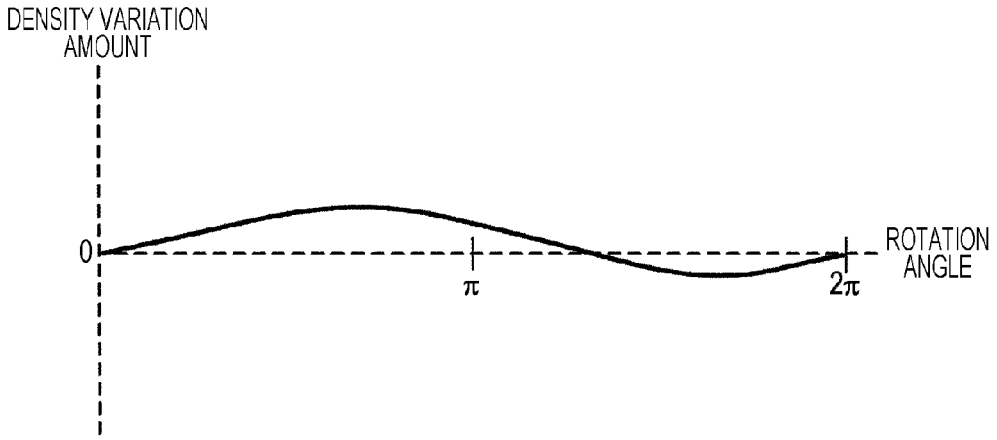
FIG. 6A and FIG. 6B, respectively are a diagram illustrating an example of a density variation (density unevenness) profile for the developing roller and a diagram illustrating an example of a density correction profile.

Subsequently, the density correcting unit 23 creates a density variation (density unevenness) profile for the developing roller 157K, which is illustrated in FIG. 6A as an example, by using the rotation phase of the developing roller 157K detected by the rotation-phase detector 22.

In the density variation profile illustrated in FIG. 6A, density variation amounts with respect to rotation angles 0 to 2π of the developing roller 157K are shown as profiles.

Figure 6B:
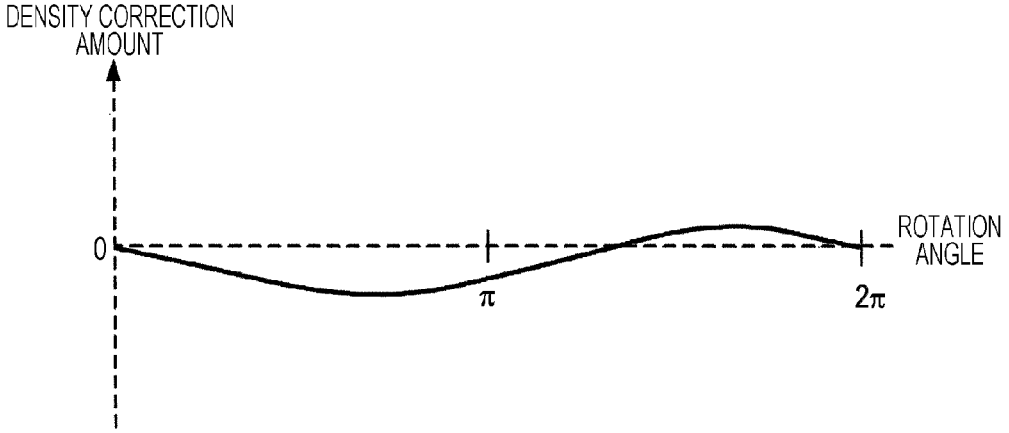

The density correcting unit 23 calculates a density correction amount, which cancels out density variations such as those illustrated in FIG. 6A, and creates a density correction profile such as that illustrated in FIG. 6B.

In the density correction profile illustrated in FIG. 6B, density correction amounts with respect to rotation angles 0 to 2π of the developing roller 157K are shown as profiles.

In other words, the density correcting unit 23 performs density corrections on the basis of a density correction profile such as that illustrated in FIG. 6B and the rotation phase of the developing roller 157K, so that density variations due to rotation of the developing roller 157K may be reduced.

A specific method of creating a density correction profile for detecting the rotation phase of the photoconductor drum 152K and correcting density variations due to rotation of the photoconductor drum 152K will now be described with reference to FIG. 7A to FIG. 9B.

Figure 7A:
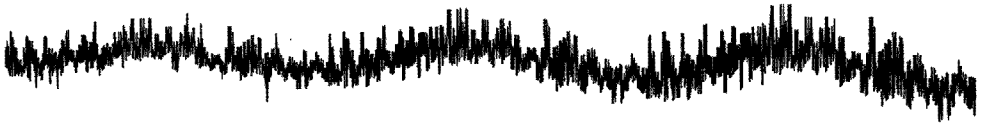
FIG. 7A and FIG. 7B, respectively are a diagram illustrating an exemplary waveform of the AC component of the power supply that is output by the developing-bias applying device and a diagram illustrating an exemplary waveform obtained after the waveform of the AC component of the power supply has passed through the filter.
Figure 7B:
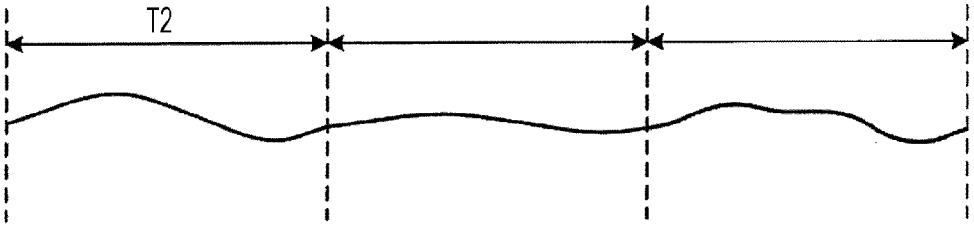

FIG. 7A illustrates an exemplary waveform of the AC component of the power supply that is output by the developing-bias applying device 40. FIG. 7B illustrates an exemplary waveform obtained after the waveform of the AC component of the power supply has passed through the filter 21. Note that parameters that are different from those in the case of detecting the rotation phase of the developing roller 157K are set to the filter 21 in order to obtain a varying waveform for detecting the rotation phase of the photoconductor drum 152K.

In the case where the rotation-phase detector 22 detects the rotation phase of the photoconductor drum 152K, as illustrated in FIG. 7B, the rotation-phase detector 22 divides the AC component waveform into regions corresponding to each rotation period T2 of the photoconductor drum 152K.

Figure 8:
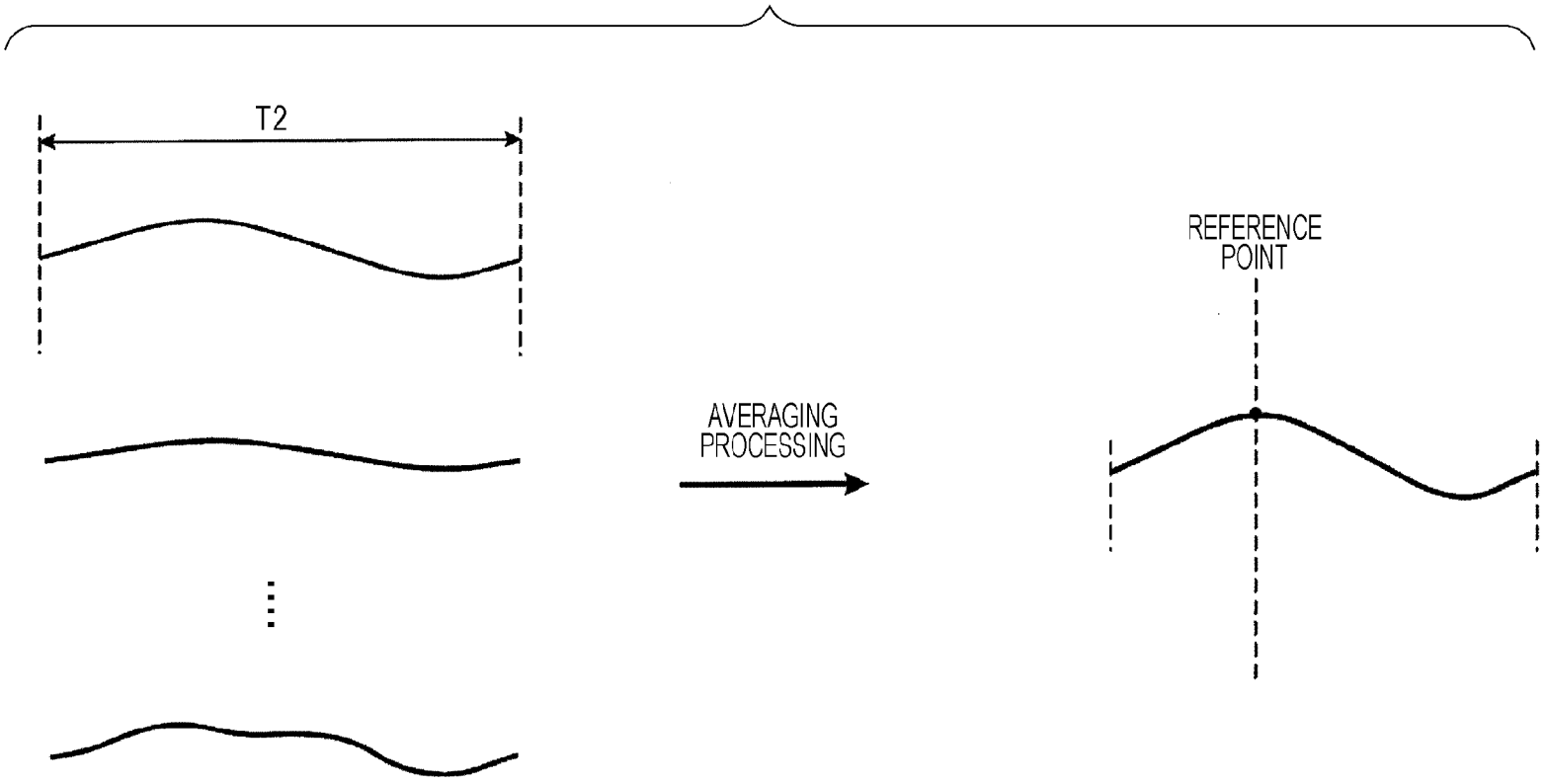
FIG. 8 is a diagram illustrating the averaging processing performed by the rotation-phase detector.

Then, as illustrated in FIG. 8, the rotation-phase detector 22 performs averaging processing on the divided plural regions of the AC component waveform by a method similar to that in the case of detecting the rotation phase of the developing roller 157K so as to calculate the average value and detects a feature point of the average value of the AC component waveform, which has been calculated.

Figure 9A:
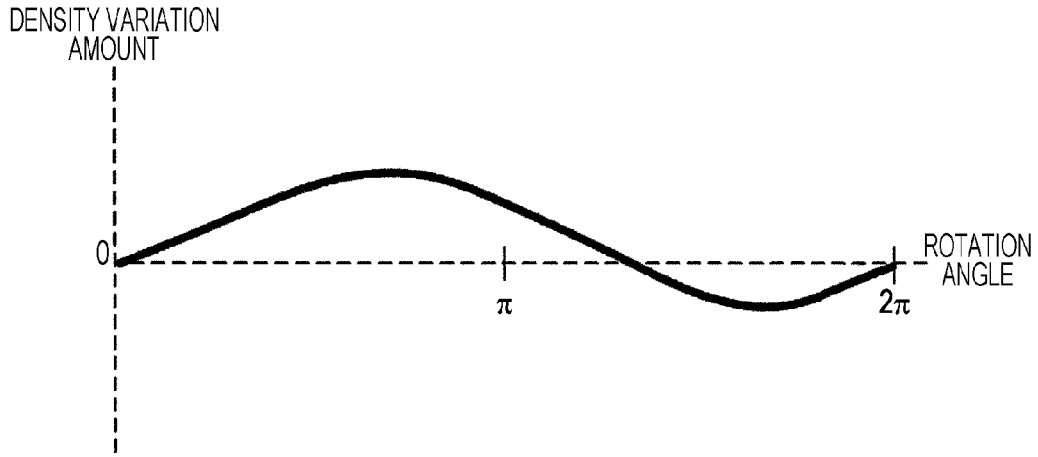
FIG. 9A and FIG. 9B, respectively are a diagram illustrating an example of a density variation (density unevenness) profile for the photoconductor drum and a diagram illustrating an example of a density correction profile.

Subsequently, the density correcting unit 23 creates a density variation (density unevenness) profile for the photoconductor drum 152K, such as that illustrated in FIG. 9A as an example, by using the rotation phase of the photoconductor drum 152K detected by the rotation-phase detector 22. In addition, the density correcting unit 23 calculates a density correction amount, which cancels out density variations such as those illustrated in FIG. 9A, and creates a density correction profile such as that illustrated in FIG. 9B.

Figure 9B:
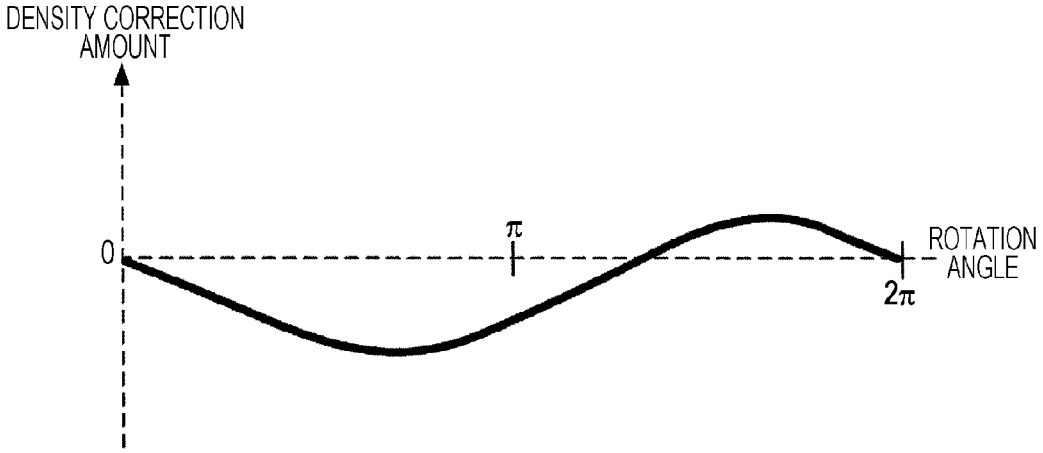

Then, the density correcting unit 23 performs density corrections on the basis of a density correction profile such as that illustrated in FIG. 9B and the rotation phase of the photoconductor drum 152K, so that density variations due to rotation of the photoconductor drum 152K may be reduced as in the case of the developing roller 157K.

Although the case of detecting a rotation phase of a rotating body, such as the developing roller 157K or the photoconductor drum 152K, in the image forming unit 14K, which forms an image with a black toner, and correcting density variations due to rotation of the rotating body, such as the developing roller 157K or the photoconductor drum 152K, has been described above, density variations due to rotation of a rotating body are corrected in a similar manner also in each of the image forming units 14C, 14M and 14Y. In other words, the rotation phases of the photoconductor drums 152C, 152M, and 152Y and the rotation phases of the developing rollers are detected, and density variations are corrected also in the image forming units 14C, 14M and 14Y.

In addition, in the case where the rotation phase of the developing roller 157K or the photoconductor drum 152K is detected in the above-described manner, the rotation phase may be kept updated to the most recent average value of the AC component of the power supply of the developing-bias applying device 40 in a predetermined number of regions. Alternatively, after the rotation phase has been detected, the rotation phase may not be updated until one print job (print instruction) is completed. In other words, since the most recent rotation phase of the developing roller 157K or the photoconductor drum 152K may be estimated from the rotation phase, which has been detected, and the rotation period of the developing roller 157K or the photoconductor drum 152K, which is determined beforehand, correction of density variations may be performed periodically on the basis of the estimated rotation phase.

This is because a rotation phase relationship between rotating bodies, such as the developing roller 157K and the photoconductor drum 152K, will not be markedly changed until a series of image forming processing is completed. In addition, in the case where the most recent rotation phase is constantly being detected, and density variations are corrected on the basis of the detected rotation phase, when noise or the like is superposed on the waveform of the AC component of the power supply due to some unexpected factors, there is a possibility that the detected rotation phase will be displaced, and as a result, the density variations will not be appropriately corrected.

However, in the case where the print volume of one print job is excessive, if a rotation phase is not updated until this print job is completed, there is a possibility that the rotation phase will be gradually displaced, and as a result, the density variations will not be appropriately corrected. Therefore, it is desirable to detect the rotation phase of the rotating body again after a certain time has passed and update the rotation phase used as a basis for corrections of density variations.

[Modification]

Although the case of detecting a rotation phase of the rotating body (developing roller 157K or photoconductor drum 152K), whose rotation phase is to be detected, by dividing the AC component waveform of the power supply of the developing-bias applying device 40 in accordance with the rotation period of the rotating body, has been described in the above exemplary embodiment, the present invention is not limited to this. For example, a reference point used for detecting the rotation phase may be calculated by detecting a frequency component corresponding to the rotation period of the rotating body, whose rotation phase is to be detected, by performing frequency analysis on the AC component waveform of the power supply of the developing-bias applying device 40.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier configured to hold a developer image;

a developer transport unit configured to transport a developer to the image carrier by performing a rotational movement;

a voltage application unit configured to apply, between the developer transport unit and the image carrier, a voltage that contains a direct-current voltage component and an alternating-current voltage component and that is used for transporting the developer from the developer transport unit to the image carrier;

a detector configured to detect a rotation phase of the developer transport unit based on an alternating-current component waveform of a power supply of the voltage application unit; and a density correcting unit configured to correct density variations due to rotation of the developer transport unit based on the rotation phase of the developer transport unit detected by the detector, wherein the density correcting unit does not correct the density variations when a variation amount of the alternating-current component waveform of the power supply of the voltage application unit is smaller than a predetermined value.

2. The image forming apparatus according to claim 1, wherein the detector is configured to divide the alternating-current component waveform into a plurality of regions corresponding to each rotation period of the developer transport unit, calculate an average value of the alternating-current component waveform, which has been divided into the plurality of regions, and detect a feature point of the calculated average value of the alternating-current component waveform so as to set a reference point of the rotation phase of the developer transport unit.

3. The image forming apparatus according to claim 1, further comprising a filter configured to remove high-frequency component noise from the alternating current component waveform of the power supply of the voltage application unit.

4. The image forming apparatus according to claim 1, wherein the detector is configured to divide the alternating-current component waveform into a plurality of regions corresponding to frequency component in accordance with each rotation period of the developer transport unit, calculate an average value of the alternating-current component waveform, which has been divided into the plurality of regions, and detect a feature point of the calculated average value of the alternating-current component waveform so as to set a reference point of the rotation phase of the developer transport unit.

5. An image forming apparatus comprising:

an image carrier configured to hold a developer image;

a developer transport unit configured to transport a developer to the image carrier by performing a rotational movement;

a voltage application unit configured to apply, between the developer transport unit and the image carrier, a voltage that contains a direct-current voltage component and an alternating-current voltage component and that is used for transporting the developer from the developer transport unit to the image carrier;

a detector configured to detect a rotation phase of the developer transport unit based on an alternating-current component waveform of a power supply of the voltage application unit; and a density correcting unit configured to correct density variations due to rotation of the developer transport unit based on the rotation phase of the developer transport unit detected by the detector, wherein the density correcting unit includes:

an acquiring unit configured to acquire density-variation information that corresponds to the rotation phase of the developer transport unit by detecting a density of an image formed by the developer transport unit, a creating unit configured to create a correspondence table in which a correction amount corresponding to the rotation phase of the developer transport unit is specified based on the density-variation information acquired by the acquiring unit, and an adjusting unit configured to adjust a density value of each pixel of an image to be formed based on the rotation phase of the developer transport unit detected by the detector and the correspondence table created by the creating unit.

6. The image forming apparatus according to claim 5, further comprising a filter configured to remove high-frequency component noise from the alternating current component waveform of the power supply of the voltage application unit.

7. The image forming apparatus according to claim 5, wherein the detector is configured to divide the alternating-current component waveform into a plurality of regions corresponding to frequency component in accordance with each rotation period of the developer transport unit, calculate an average value of the alternating-current component waveform, which has been divided into the plurality of regions, and detect a feature point of the calculated average value of the alternating-current component waveform so as to set a reference point of the rotation phase of the developer transport unit.

8. An image forming apparatus comprising:

an image carrier that has a substantially cylindrical shape and is configured to hold a developer image;

a developer transport unit configured to transport a developer to the image carrier by performing a rotational movement;

a voltage application unit configured to apply, between the developer transport unit and the image carrier, a voltage that contains a direct-current voltage component and an alternating-current voltage component and that is used for transporting the developer from the developer transport unit to the image carrier;

a detector configured to detect a rotation phase of the image carrier based on an alternating-current component waveform of a power supply of the voltage application unit; and a density correcting unit configured to correct density variations due to rotation of the image carrier based on the rotation phase of the image carrier detected by the detector, wherein the density correcting unit does not correct the density variations when a variation amount of the alternating-current component waveform of the power supply of the voltage application unit is smaller than a predetermined value.

9. The image forming apparatus according to claim 8, wherein the detector configured to divide the alternating-current component waveform into a plurality of regions corresponding to each rotation period of the developer transport unit, calculate an average value of the alternating-current component waveform, which has been divided into the plurality of regions, and detect a feature point of the calculated average value of the alternating-current component waveform so as to set a reference point of the rotation phase of the image carrier.

10. The image forming apparatus according to claim 8, further comprising a filter configured to remove high-frequency component noise from the alternating current component waveform of the power supply of the voltage application unit.

11. The image forming apparatus according to claim 8, wherein the detector is configured to divide the alternating-current component waveform into a plurality of regions corresponding to frequency component in accordance with each rotation period of the developer transport unit, calculate an average value of the alternating-current component waveform, which has been divided into the plurality of regions, and detect a feature point of the calculated average value of the alternating-current component waveform so as to set a reference point of the rotation phase of the developer transport unit.

12. An image forming apparatus comprising:

an image carrier that has a substantially cylindrical shape and is configured to hold a developer image;

a developer transport unit configured to transport a developer to the image carrier by performing a rotational movement;

a voltage application unit configured to apply, between the developer transport unit and the image carrier, a voltage that contains a direct-current voltage component and an alternating-current voltage component and that is used for transporting the developer from the developer transport unit to the image carrier;

a detector configured to detect a rotation phase of the image carrier based on an alternating-current component waveform of a power supply of the voltage application unit; and a density correcting unit configured to correct density variations due to rotation of the image carrier based on the rotation phase of the image carrier detected by the detector, wherein the density correcting unit includes an acquiring unit configured to acquire density-variation information that corresponds to the rotation phase of the image carrier by detecting a density of an image formed by the image carrier, a creating unit configured to create a correspondence table in which a correction amount corresponding to the rotation phase of the image carrier is specified based on the density-variation information acquired by the acquiring unit, and an adjusting unit configured to adjust a density value of each pixel of an image to be formed based on the rotation phase of the image carrier detected by the detector and the correspondence table created by the creating unit.

13. The image forming apparatus according to claim 12, further comprising a filter configured to remove high-frequency component noise from the alternating current component waveform of the power supply of the voltage application unit.

14. The image forming apparatus according to claim 12, wherein the detector is configured to divide the alternating-current component waveform into a plurality of regions corresponding to frequency component in accordance with each rotation period of the developer transport unit, calculate an average value of the alternating-current component waveform, which has been divided into the plurality of regions, and detect a feature point of the calculated average value of the alternating-current component waveform so as to set a reference point of the rotation phase of the developer transport unit.

* * * * *